US007153011B2

(12) United States Patent
Shen et al.

(10) Patent No.: US 7,153,011 B2
(45) Date of Patent: Dec. 26, 2006

(54) VEHICLE LIGHT ARRANGEMENT WITH COLORING EFFECT

(75) Inventors: Penn Shen, Long Beach, CA (US); Christof Schotte, Assebroek (BE)

(73) Assignee: A.L Lightech Inc., Orange, CA (US)

( * ) Notice: Subject to any disclaimer, the term of this patent is extended or adjusted under 35 U.S.C. 154(b) by 67 days.

(21) Appl. No.: 10/977,306

(22) Filed: Oct. 28, 2004

(65) Prior Publication Data

US 2006/0092655 A1 May 4, 2006

(51) Int. Cl.
*F21V 11/00* (2006.01)

(52) U.S. Cl. ..... 362/510; 362/19; 362/293; 362/545; 359/502

(58) Field of Classification Search ..... 362/19, 362/293, 510, 545; 359/502
See application file for complete search history.

(56) References Cited

U.S. PATENT DOCUMENTS 5,684,633 A * 11/1997 Lutz et al. ..... 362/293
6,469,622 B1 * 10/2002 Komatsu et al. ..... 362/510

* cited by examiner

*Primary Examiner*—Stephen F Husar
(74) *Attorney, Agent, or Firm*—Raymond Y. Chan; David & Raymond Patent Firm

(57) ABSTRACT

A vehicle light arrangement, provided for producing a coloring effect on a vehicle body, wherein the vehicle light arrangement, incorporated with a light housing and a light source, comprises a plurality of polarizing segments provided for filtering lights at a predetermined wavelength to produce the coloring effect when the light source is switched on. When the light source is switched off, the vehicle light arrangement acts as a light screen to invisibly hide the light source. The polarizing segments can be formed on a polarizing filter layer, which is coated on an inner side of a lens body mounting at an opening of the light housing. A light reflective layer is also formed at a surrounding wall of the light housing.

15 Claims, 4 Drawing Sheets

VEHICLE LIGHT ARRANGEMENT WITH COLORING EFFECT

BACKGROUND OF THE PRESENT INVENTION

1. Field of Invention

The present invention relates to a vehicle light arrangement and more particularly to a vehicle light arrangement that produces a coloring effect that is within a certain regulation restrictions, wherein the vehicle light arrangement has a plurality of polarizing segments provided for filtering lights at a predetermined wavelength, so as to produce the coloring effect when a light source is turned on. When the light source is turned off, the polarizing segments form a light screen with a primary color matching with the color of the vehicle body to imitate as part of the vehicle body.

2. Description of Related Arts

Signal lights, especially those on automobiles, needless to say, serve a practical purpose rather than a decorative one. Since the existence of motor vehicles, development has mostly been focused on their performances, due to the fact that most people need it for practical purposes, rather than as a luxurious piece of possession. Eventually, when performances of motor vehicles are more or less stabilized, vehicles manufacturers started to make more effect in designing their appearance, and work on the design on the appearance of the vehicle to provide distinction from other make and to provide more attractions to potential purchasers.

A vehicle is most recognized by its shape and color of the car exterior since the appearance of exterior gives the first impression to consumers. And, color is one of the most distinctive features of some vehicle models.

Signal lights cover, being part of the exterior of a vehicle, could easily have played a role in creating impressions on consumers. However, due to the fact that the existence of signal lights was generally to serve a practical function of providing standardized visual signal to other road users, customizability of such signal light covers, in the sense of their colors, is very low. Car designers never actually can do much with them, when it comes to designing for the exterior of a vehicle, especially when they have to follow certain government regulations such as front light shall be white, yellow or amber, and rear lights shall be red or amber.

As a result, not only can signal light covers not help in enhancing the impression of the appearance of the vehicle to consumers, they, in fact, create the problem of not matching with the color of the car exterior. However, little has been done to help that situation because people generally have the feelings that regulations are to be followed and are, therefore, not motivated to find a way to get by.

In an age full of advance technology, there should no longer be any excuse as to why the problem of not being able to customize the color of signal light covers cannot be solved, especially when products customizability now plays a very important role in the consumer world. Hence, signal light covers that can be customized should be developed, so as to provide higher flexibility to vehicle exterior designers for attracting potential buyers, and to vehicle owners for customizing their own vehicles according to their personal tastes and preferences.

SUMMARY OF THE PRESENT INVENTION

A main object of the present invention is to provide a vehicle light arrangement to produce a coloring effect, comprising a light housing, at least a light source and a vehicle light arrangement having a plurality of polarizing segments, wherein the vehicle light arrangement normally forms a light screen to invisibly hide the light source when the light source is switched off and is arranged in such a manner that when a light is generated by the light source, the polarizing segments filter the light at a predetermined wavelength to create the coloring effect so as to provide a visible light signal of the vehicle light arrangement.

Another object of the present invention is to provide a vehicle light arrangement that forms the light screen with a primary color matching with a color of the vehicle body for imitating as an integral part of the vehicle body when the light source is switched off.

Another object of the present invention is to provide a vehicle light arrangement, which further comprises a lens body such that a polarizing filter layer having the polarizing segments are evenly formed thereon.

Another object of the present invention is to provide a vehicle light arrangement, so as to increase a light intensity within the light cavity, wherein the polarizing filter layer evenly disperses the light to generate the coloring effect of the vehicle light arrangement.

Another object of the present invention is to provide a vehicle light arrangement, wherein the polarizing segments are identical to filter the light from the light source for generating a single color visible light signal.

Another object of the present invention is to provide a vehicle light arrangement, wherein the polarizing segments are not identical to filter the light from the light source for generating a multi-color visible light signal.

Another object of the present invention is to provide a vehicle light arrangement, wherein the light source is any light source, such that the vehicle light arrangement has a high flexibility of accommodating to any existing vehicles.

Another object of the present invention is to provide a vehicle light arrangement, wherein the light source is LED, such that a simple, durable and easily replaceable light source is used for the production of the light.

Another object of the present invention is to provide a vehicle light arrangement, wherein a light reflective layer is formed at a surrounding wall of the light housing such that all light produced by the light source is reflectively guided towards the vehicle light arrangement, minimizing energy loss.

Another object of the present invention is to provide a vehicle light arrangement, which provides an economical solution to produce the great decorative effect due to the popularity and low in cost of wavelength filters.

Another object of the present invention is to provide a vehicle light arrangement, wherein the polarizing segments are easily and simply provided to both existing cars and cars being manufactured by means of adhesive or coating.

Accordingly, in order to accomplish the above objects, the present invention provides a vehicle light arrangement, comprising:

a light housing adapted for mounting at a vehicle body, having a light cavity and an opening communicating with the light cavity;

at least a light source supported within the light cavity for generating light towards the opening; and a vehicle light arrangement, having a plurality of polarizing segments, provided at the opening of the light housing to enclose the light cavity thereof, wherein the vehicle light arrangement normally forms a light screen to invisibly hide the light source within the light cavity when the light source is switched off and is arranged in such a manner that when the light source generates the light to an exterior of the light housing through the vehicle light arrangement, the polarizing segments filter the light at a predetermined wavelength to create a coloring effect of the vehicle light arrangement so as to provide a visible light signal of the vehicle light arrangement.

These and other objectives, features, and advantages of the present invention will become apparent from the following detailed description, the accompanying drawings, and the appended claims.

DETAILED DESCRIPTION OF THE PREFERRED EMBODIMENT

Figure 1:
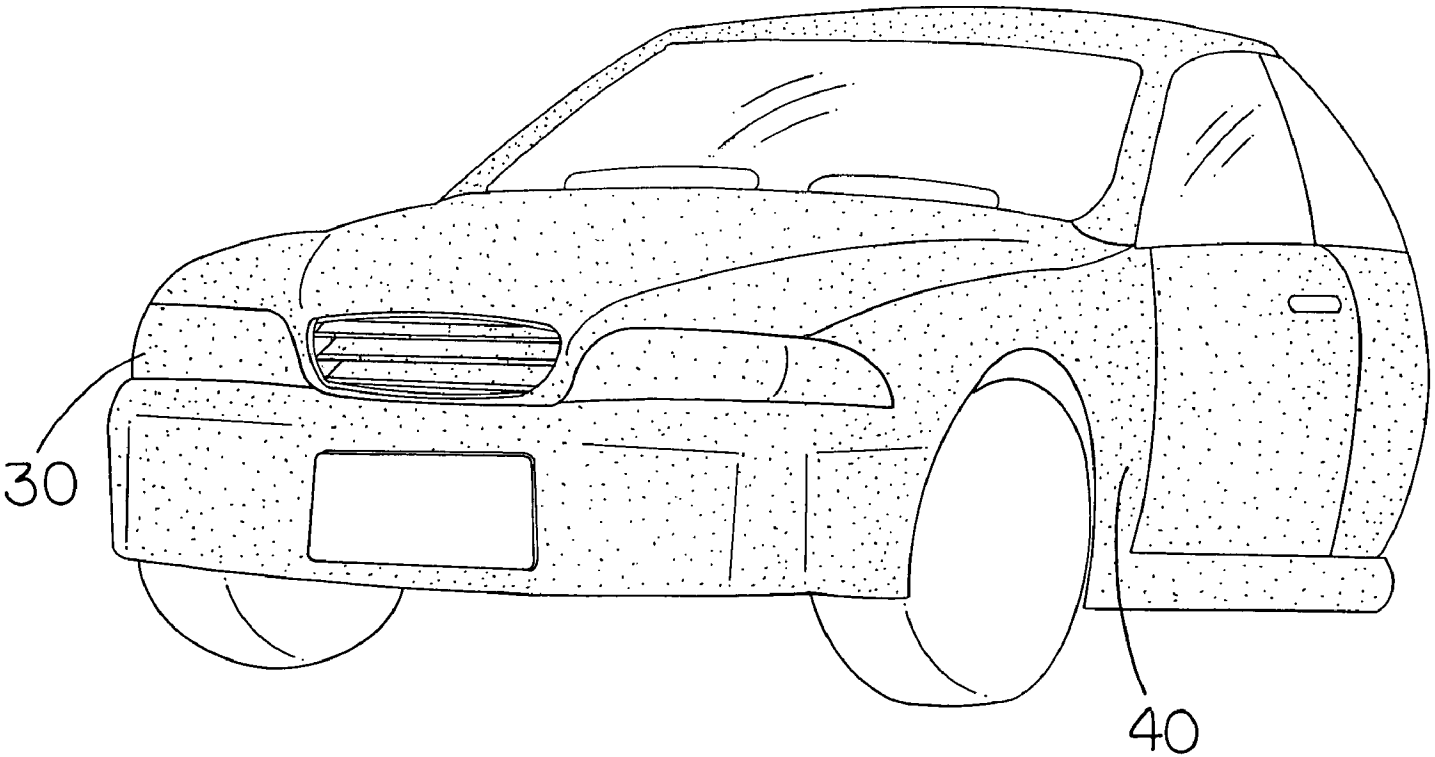
FIG. 1 is a cross-sectional view of the vehicle light arrangement on a vehicle according to the preferred embodiment of the present invention.
Figure 2:
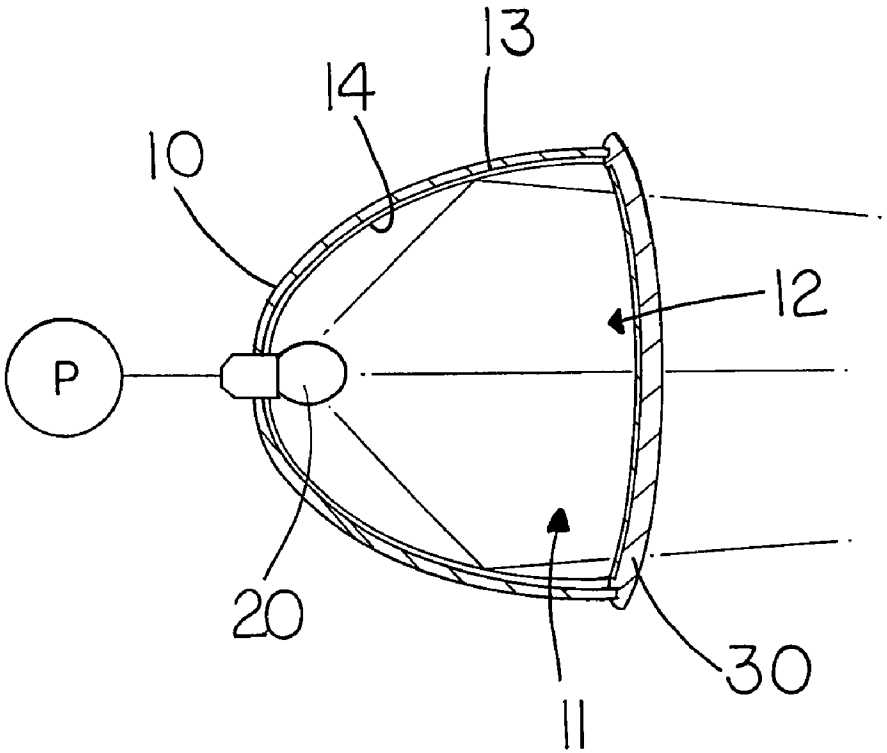
FIG. 2 is a cross-sectional view of the vehicle light arrangement according to the above preferred embodiment of the present invention.

Referring to FIG. 1 and FIG. 2 of the drawings, a vehicle light arrangement with coloring effect for providing a regulated visual signal having a predetermined regulated color according to a preferred embodiment of the present invention is illustrated, wherein the vehicle light arrangement comprises a light housing 10, at least a light source 20 and a vehicle light arrangement 30.

The light housing 10 has a light cavity 11 and an opening 12 communicating with the light cavity, where in the light housing 10 is adapted for mounting at a vehicle body 40. The light cavity 11 of the light housing 10 supports the light source 20 therewithin, in such a manner that the light source 20 generates a light towards the opening 12, such that light generated by the light source 20 is visible at the opening 12.

Figure 3:
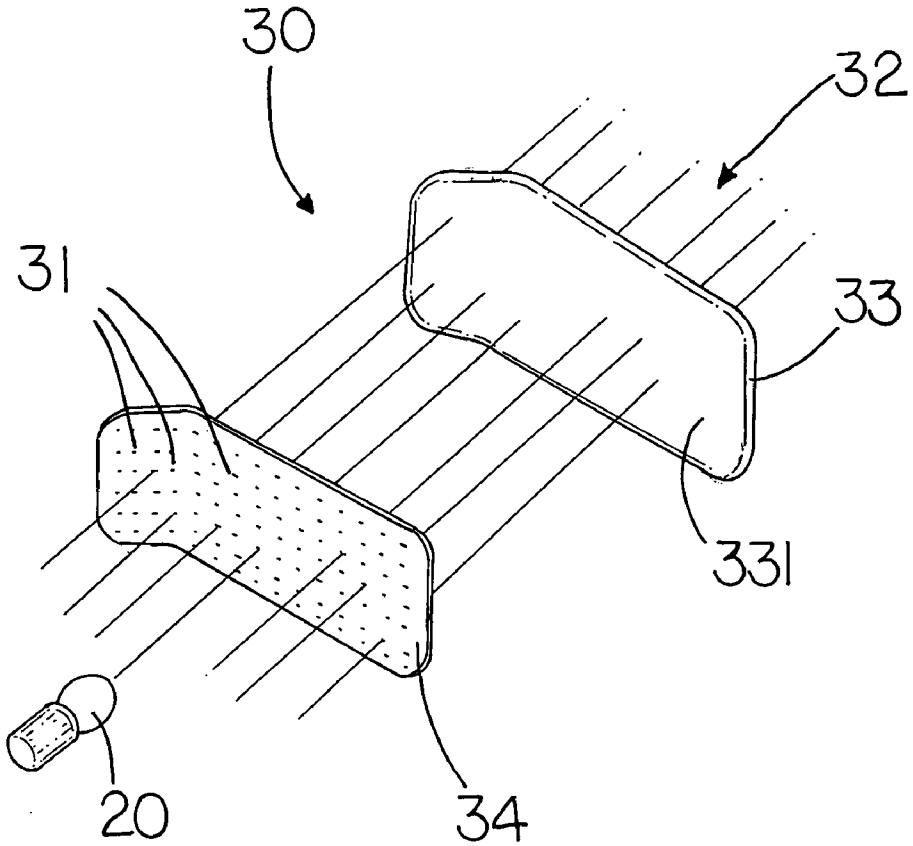
FIG. 3 is an exploded view of the vehicle light arrangement according to the above preferred embodiment of the present invention.

Referring to FIG. 3 of the drawings, the vehicle light arrangement 30 has a plurality of polarizing segments 31. The polarizing segments 31 are provided at the opening 12 of the light housing 10 so as to enclose the light cavity 11 of the light housing 10 inside the light cavity 11.

When the light source 20 is not turned on, the vehicle light arrangement 30 acts as a light screen 32 to invisibly hide the light source 20 within the light cavity 10, such that the light source 20 cannot be seen through the vehicle light arrangement 30.

The vehicle light arrangement 30 is arranged in such a manner that when the light source 20 generates the light to an exterior of the light housing 10 through the vehicle light arrangement 30, the polarizing segments 31 filter the light at a predetermined wavelength to create a coloring effect of the vehicle light arrangement 30. This will provide a visible light signal of the vehicle light arrangement 30, wherein the coloring effect of the visible light signal very often is a regulated color.

The polarizing segments 31 of the vehicle light arrangement 30 forms the light screen 32 with a primary color matching with a color of the vehicle body for imitating as an integral part of the vehicle body when the light source 20 is switch off, such that the problem of mismatching of color between the vehicle body and the light lens of conventional vehicles now has a solution.

The effect of the light screen 32 is that the light screen 32 is allowed to be of any desired color, which can be of no relation to the coloring effect of the vehicle light arrangement 30. When the light source 20 is switched off, the color of the vehicle light arrangement is the color of the light screen 32. However, when the light source 20 is switched on, the color of the vehicle light arrangement 30 is the coloring effect of the vehicle light arrangement 30.

When the light source 20 is switched off, the light screen 32 has a mirror effect on the light source 20, such that the image of the light source 20 does not pass through light screen 32. A primary color of the light screen 32 is formed by the polarizing segments 31 of the vehicle light arrangement 30 in such a manner that the primary color matches with a color of the vehicle body, so as to imitate as an integral part of the vehicle body when the light source is switch off.

Such an arrangement provides flexibility of the exterior designer of the vehicle. Unlike conventional exterior of a vehicle light housing where the color has to be consistent with the regulations due to the fact that the color of the exterior of the vehicle light housing would not change, whether or not the light source is on or off, the color of the exterior of the light housing 10 of the present invention is independent from the regulated colors since the color of the exterior of the light housing 10 will change to the coloring effect when the light is generated by the light source 20, through the filtering of the generated light by the polarizing segments 31.

As a result, the exterior designer of the vehicle can freely choose the color of the exterior of the light housing 10, providing the designer with a wider flexibility in designing the outlook of the vehicle. The exterior of the light housing 10 can now be designed to enhance the outlook of the vehicle. Not only can it serve a practical purpose at night to provide signal lighting for the vehicle, in day time, it also serves a decorative purpose.

An owner of the vehicle may also change the color of the exterior of the light housing 10 according to his own taste and preference upon purchasing the vehicle.

It is worth mentioning that there is no limitation on the material of the light screen 32 as long as it allows light generated by the light source 20 to pass through forming the coloring effect. More specifically, the light screen 32 can either be made of glass or plastic.

According to the preferred embodiment of the present invention, the vehicle light arrangement 30 comprises a lens body 33 and a polarizing filter layer 34. The lens body 33 is provided for mounting at the opening 12 of the light housing 10. The polarizing filter layer 34, on which the polarizing segments 31 are evenly formed, is coated on an inner side 331 of the lens body 33. This application of the polarizing filter layer 34 on the inner side 331 of the lens body 33 is most suitable for cars that are being manufactured.

As for existing cars, owners can easy add the polarizing filter layer 34 onto the inner side 331 of the lens body 33 of their cars by adding some adhesive on the polarizing filter layer 34 so as to stick onto the inner side 331 of the lens body 33.

The convenience of the addition of the polarizing filter layer 34 provides a high utility, to both car manufacturers as well as existing car owners. Car owners may also easily change the lens body 33 according to the color they desire, and accordingly, change the polarizing filter layer 34.

When the light source 20 generates the light to increase a light intensity within the light cavity 11 with respect to the exterior of the light housing 10, the polarizing filter layer 34 evenly disperses the light to allow the predetermined wavelength to pass through the lens body 33 so as to generate the color effect of the vehicle light arrangement 30.

It is worth mentioning that the light source 20 comprises at least a LED or other sorts of light source such as light bulb or filament. According to the preferred embodiment of the present invention, the light housing 10 is a light emitting diode (LED) since it is small, easy to install, durable, does not cause a lot of heating up and therefore energy efficient.

The color of the light source 20 is not limited to any particular color since it does not affect the color of the coloring effects of the vehicle light arrangement 30. The reason is that it is apparent that the polarizing segments 31 controls the coloring effects of the vehicle light arrangement 30 by filtering whatever color of light from the light source 20 to consistently form the color effect at the predetermined wavelength.

The light source 20 is supported at a focal point of the light housing 10 so as to generate the light towards the vehicle light arrangement, the reason being that the light produced by the light source 20 will focus towards the opening 12 of the light housing 10 better than if the light source 20 is place outside the focal point of the light housing 10.

When a single color visible light signal is required, the polarizing segments 31 are identical, meaning that the light from the light source 20 is consistently filtered to form the coloring effect of the vehicle light arrangement 30 at the predetermined wavelength.

However, when more than one color visible light signal is required, the polarizing segments 31 do not have to be identical, such that the light source 20 is filtered differently by each of the different polarizing segments 31, so as to form more than one coloring effects of the vehicle light arrangement 30 at more than one predetermined wavelengths.

An advantage of such an arrangement is that even when two or more coloring effects are to be produced, only one light source 20 is required since the different polarizing segments 31 will accordingly filter the light generated by the light source 20 and produce a coloring effect accordingly. Hence, car designers or car owners can easily customize their own lens body 33, by customizing the polarizing segments 31 on the polarizing filter layer 34, so as to show their personal taste and creativity.

In order to enhance the flexibility of the vehicle light arrangement 30, the light source 20 is replaceable so that when the light source 20 malfunctions, the light source 20 can easily be replaced without the need of replacing the entire vehicle light arrangement 30. This will also minimize the maintenance cost of the vehicle light arrangement 30, as well as the overall vehicle.

In order to effectively produce the coloring effect by the vehicle light arrangement, the light housing 10 further has a light reflective layer 14 formed at a surrounding wall 13 of the light cavity 11 for reflectively guiding the light towards the vehicle light arrangement 30. The light generated by light source 20 travels in all directions, including towards the light housing. This will make the light generated by the light source 20 not as bright as it can be, and therefore waste power.

By placing the light reflective layer 14 at the surrounding wall 13 of the light cavity 11, the light directed towards the light housing 10 is reflected to towards the vehicle light arrangement 30, which makes the light originally to be wasted useful, which makes the coloring effect of the vehicle lighting arrangement more powerful and not wasting energy.

Another advantage of the vehicle light arrangement of the present invention is that more than one coloring effects can be produced within the same light housing 10 non-simultaneously, meaning that two or more different coloring effects are to be produced by the vehicle light arrangement at different times.

Figure 4:
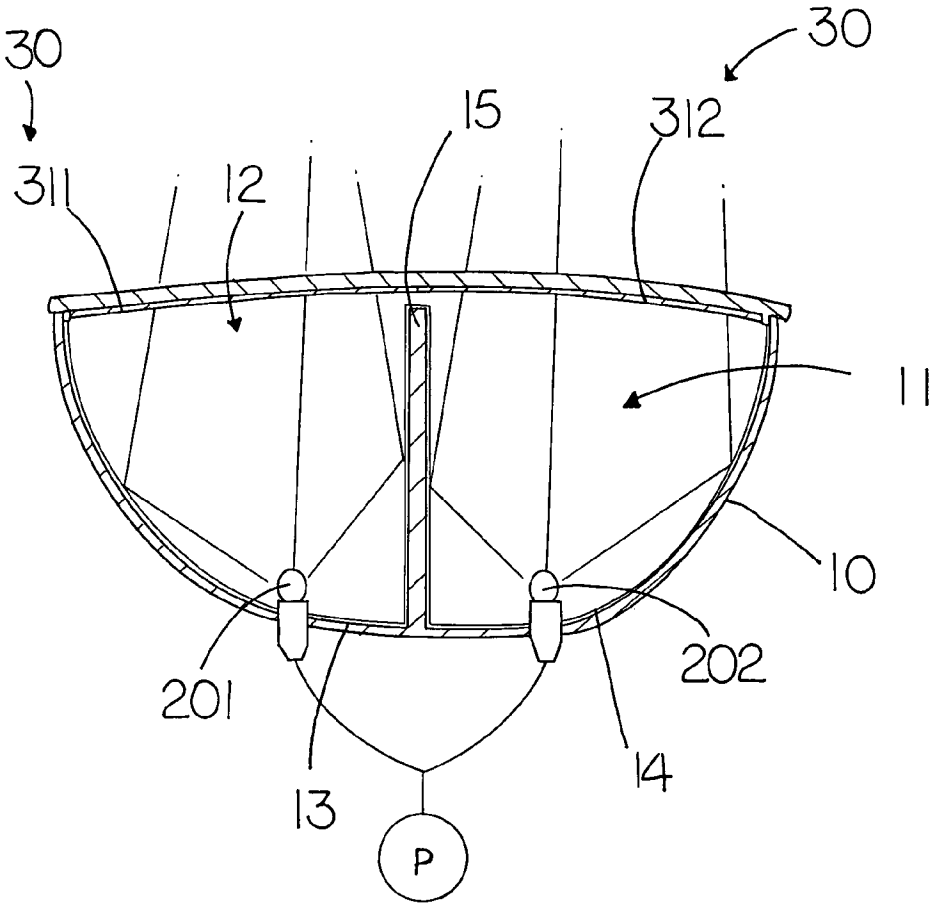
FIG. 4 is cross sectional view of the vehicle light arrangement with two light source according to the above preferred embodiment of the present invention.

Referring to FIG. 4 of the drawings, as an example, when a first and a second coloring effects are to be produced by the vehicle light arrangement 30 not at the same time, such that only one of the two coloring effects will be produced at one particular time, the vehicle light arrangement 30 comprises a first polarizing segment 311, a second polarizing segment 312, a first light source 201 and a second light source 202.

The first and second light sources 201 and 202 are supported within the light cavity 11 of the light housing 10 in such a manner that each of the light generated by the light sources 201 and 202 are directed to the polarizing segments 311 and 312 respectively, such that each of the polarizing segments 311 and 312 will only be shone by one of the light sources correspondingly.

And more specifically, when the first light source 201 is turned on and the second light source 202 is turned off, only the first polarizing segment 311 will produce a coloring effect, which is the first coloring effect and the second polarizing segment 312 will not produce any coloring effects. And when the second light source 202 is turned on and the first light source 201 is turned off, only the second polarizing second 312 will produce a coloring effect, which is the second coloring effect and the first polarizing segment 311 will not produce any coloring effects.

In order to further control that the light produced by the first and second light sources 201 and 202 will only reach their corresponding polarizing segments, i.e., 311 and 312 respectively, meaning that they do not reach a wrong polarizing segment, the light housing 10 further comprising a light partition 15.

The light partition 15 is sized and provided on the surrounding wall 13 in such a manner that the light provided by the first light source 201 is totally prevented from reaching the second polarizing segment 312 and that by the second light source 202 from the first polarizing segment 311 respectively.

Furthermore, when both the coloring effects are required at the same time, i.e., both the first light source 201 and the second light source 202 are turned on so that the first polarizing segment 311 is to produce the first coloring effect and the second polarizing segment 312 is to produce the second coloring effect, the intensity of both coloring effects are more or less equal such that the coloring effects can be equally as sharp and will not confuse the viewers.

Such design reduces the overall cost of the vehicle due to a lower installation cost of vehicle lights, as well as a less number of vehicle lights are required, since only one light housing 10 will be required for two, or even, more than two lighting effects.

As long as the light sources 20 are adequately position, and with the help of the light partition 15, the light produced by each light sources 20 will only reach its desired polarizing segments 31. Furthermore, the maintenance costs of such vehicle light arrangements are also minimized since only one vehicle light is required regardless of the number of coloring effects are required.

The vehicle light arrangement 30 of the present invention not only serves a practical purpose of providing a signal light but also provides a decorative effect to the automobile. The present invention opens up a new design area for automobile manufacturers to work on in order to attract potential buyers.

It is worth mentioning that the present invention allows any coloring effect to be produced by light sources 20 of any color, or simply one color, such that a mistake in the color of the light source 20 of will not affect the coloring effect produced by the vehicle light arrangement. The coloring effect will always be controlled by the polarizing segments 31 of the vehicle light arrangement and independent from the color of the light sources 20.

There are many signal lights required on an automobile. Some has to be in amber, some white and some red. Light sources 20 may easily be mixed up in the manufacturing process. The vehicle light arrangement 30, together with the light source 20 will produce the coloring effect after filtering by the polarizing segments 31 regardless of what the color of the light sources are. This simplified manufacturing process of automobiles has an advantage of reducing the production cost of automobiles.

Furthermore, since the vehicle light arrangement 30 polarizes the light produced by the light source 20, meaning that only light traveling at the predetermined wavelength will travel to the exterior of the light housing through the vehicle light arrangement 30 and light traveling at any other wavelengths will be blocked. This reduces glaring produced by the light source 20 that would blind viewers, hence solving the long standing problem of blinding drivers in the opposite traffic, which could easily cause accidents on the road.

Furthermore, many a times, even the same shade of light will be different if produced by different manufacturers. The present invention and more particularly, the use of a vehicle light arrangement 30 with the light source 20, helps standardizing the color of the coloring effect.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A vehicle light arrangement, comprising:

a light housing adapted for mounting at a vehicle body, having a light cavity and an opening communicating with said light cavity, wherein said light housing comprises a light reflective layer formed at a surrounding wall of said light cavity;

at least a light source supported within said light cavity for generating light towards said opening, wherein said light reflective layer is adapted for reflectively guiding said light to project towards said opening of said light housing so as to enhance a light intensity of said light; and a vehicle light arrangement comprising a lens body mounted at said opening of said light housing and a polarizing filter layer provided on an inner side of said lens body, wherein said polarizing filter layer has a plurality of polarizing segments to filter said light generated from said light source, wherein when said light source is switched off, said vehicle light arrangement forms a light screen to invisibly hide said light source within said light cavity, wherein when said light source is switched on, said polarizing filter layer filters said light from said light source that each of said polarizing segments allows a predetermined wavelength of said light passing through said lens body to an exterior of said light housing through said opening thereof, such that said vehicle light arrangement creates a coloring effect of said light to provide a visible light signal of said vehicle light arrangement.

2. The vehicle light arrangement, as recited in claim 1, wherein said polarizing filter layer forms said light screen with a primary color matching with a color of said vehicle body for imitating as an integral part of said vehicle body when said light source is switched off.

3. The vehicle light arrangement, as recited in claim 1, wherein said polarizing filter layer forms a mirror screen as said light screen to provide a mirror effect when said light source is switched off.

4. The vehicle light arrangement, as recited in claim 2, wherein said polarizing segments are identical to filter said light of said light source for allowing said predetermined wavelength of said light passing through said lens body so as to generate a single color visible light signal when said light source is switched on.

5. The vehicle light arrangement, as recited in claim 3, wherein said polarizing segments are identical to filter said light of said light source for allowing said predetermined wavelength of said light passing through said lens body so as to generate a single color visible light signal when said light source is switched on.

6. The vehicle light arrangement, as recited in claim 2, wherein said polarizing segments are not identical to filter said light of said light source for allowing different wavelengths of said light passing through said lens body so as to generate a multi-color visible light signal when said light source is switched on.

7. The vehicle light arrangement, as recited in claim 3, wherein said polarizing segments are not identical to filter said light of said light source for allowing different wavelengths of said light passing through said lens body so as to generate a multi-color visible light signal when said light source is switched on.

8. The vehicle light arrangement, as recited in claim 4, wherein said light source comprises at least a LED supported at a focus point of said light housing to generate said light towards said vehicle light arrangement.

9. The vehicle light arrangement, as recited in claim 5, wherein said light source comprises at least a LED supported at a focus point of said light housing to generate said light towards said vehicle light arrangement.

10. The vehicle light arrangement, as recited in claim 6, wherein said light source comprises at least a LED supported at a focus point of said light housing to generate said light towards said vehicle light arrangement.

11. The vehicle light arrangement, as recited in claim 7, wherein said light source comprises at least a LED supported at a focus point of said light housing to generate said light towards said vehicle light arrangement.

12. The vehicle light arrangement, as recited in claim 4, wherein said light source comprises at least a replaceable light bulb to generate said light towards said vehicle light arrangement.

13. The vehicle light arrangement, as recited in claim 5, wherein said light source comprises at least a replaceable light bulb to generate said light towards said vehicle light arrangement.

14. The vehicle light arrangement, as recited in claim 6, wherein said light source comprises at least a replaceable light bulb to generate said light towards said vehicle light arrangement.

15. The vehicle light arrangement, as recited in claim 7, wherein said light source comprises at least a replaceable light bulb to generate said light towards said vehicle light arrangement.

* * * * *